US006620006B2

(12) United States Patent
Suganuma et al.

(10) Patent No.: US 6,620,006 B2
(45) Date of Patent: Sep. 16, 2003

(54) TILT AND TRIM CONTROL AND COWLING ARRANGEMENT FOR MARINE DRIVE

(75) Inventors: Yasuo Suganuma, Shizuoka (JP); Akihiro Onoue, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/906,885

(22) Filed: Jul. 16, 2001

(65) Prior Publication Data

US 2003/0013359 A1 Jan. 16, 2003

(30) Foreign Application Priority Data

Jul. 14, 2000 (JP) ..... 2000-215163

(51) Int. Cl.[7] ..... B63H 20/32
(52) U.S. Cl. ..... 440/77; 440/61 T
(58) Field of Search ..... 440/53, 61, 84–87

(56) References Cited

U.S. PATENT DOCUMENTS 4,776,819 A 10/1988 Yamamoto et al.
4,824,407 A 4/1989 Torigai et al.
4,934,969 A * 6/1990 Kuragaki ..... 440/1
4,971,587 A * 11/1990 Uchida et al. ..... 440/77
5,261,841 A * 11/1993 Imaeda ..... 440/61
5,662,213 A * 9/1997 Kattler et al. ..... 200/302.3
5,967,867 A * 10/1999 Rinzaki et al. ..... 440/87
5,989,085 A 11/1999 Suzuki

FOREIGN PATENT DOCUMENTS

JP 60-234094 11/1985
JP 2960205 7/1999

* cited by examiner

*Primary Examiner*—Ed Swinehart
(74) *Attorney, Agent, or Firm*—Knobbe, Martens, Olson & Bear, LLP.

(57) ABSTRACT

An outboard motor includes a cowling substantially enclosing an engine therein. A tilt and trim mechanism includes a manually-actuable tilt switch for controlling tilt and trim of the motor. Both the port and starboard sidewalls of the cowling have apertures formed therethrough. The apertures are sized and configured to accomodate a tilt switch. In one embodiment, a tilt switch is arranged in one aperture and a plug is arranged in the other aperture. In another embodiment, tilt switches are arranged in both apertures.

19 Claims, 5 Drawing Sheets

TILT AND TRIM CONTROL AND COWLING ARRANGEMENT FOR MARINE DRIVE

PRIORITY INFORMATION

This application is based on and claims priority to Japanese Patent Application No. 2000-215163, filed Jul. 14, 2001.

BACKGROUND OF THE INVENTION

1. Field of the Invention

The present invention generally relates to a tilt and trim control and an associated cowling arrangement for a marine drive, and more particularly relates to the placement of a tilt and trim control switch on an outboard motor cowling.

2. Description of the Related Art

Outboard motors are often powered by internal combustion engines. The engine is typically positioned within a substantially enclosed cowling. The engine is generally vertically arranged, so that a crankshaft thereof may extend downwardly in driving relation with a water propulsion device of the motor, such as a propeller. In order to balance the motor, and because of space considerations, the engine is arranged with a crankcase of the engine facing in the direction of a watercraft to which the motor is mounted (i.e., positioned on a front side of the engine) and with the cylinder head positioned on an end of the engine facing away from the watercraft (i.e., positioned on a rear side of the engine).

A hydraulic tilt and trim system often supports and adjusts the trim position of a large outboard motor (e.g., 150 hp or greater). The tilt and trim system typically includes hydraulic actuators that operate between a clamping bracket, which is attached to the watercraft, and a swivel bracket that supports the outboard motor. A pivot pin connects the swivel and clamping brackets together. The actuators cause the swivel bracket to pivot about the axis of the pivot pin relative to the stationary clamping bracket.

In order to control the tilt and trim system, a manually operated tilt switch can be provided in or on the outboard motor cowling. The tilt switch controls operation of the tilt and trim system. In prior references, such as in Japanese Patent No. 2960205, a single tilt switch is provided and allows an operator to actuate the switch from a position outside of the cowling. The tilt switch is affixed to only one of the starboard or port sides of the cowling.

Demand for improved watercraft performance and increased outboard motor power has grown in recent years. In order to create more powerful outboard motors, larger engines are being used. Of course, a larger engine needs a larger cowling. Such large cowlings have made operation of the tilt switch more complicated because an operator must move to a side of the watercraft in order see and operate the tilt switch, which is affixed to only one side of the cowling. This is inconvenient.

In order to further increase power, some watercraft employ a pair of outboard motors mounted side-by-side on a transom of the watercraft. When a pair of outboard motors are mounted side-by-side in this manner, a space between the adjacent motors becomes narrow, expecially if the motors are large. As discussed above, the tilt switch is typically arranged in or on only one side of the cowling. As such, the tilt switch of at least one of the outboard motors is located within the narrow space between the motors. Accessing and operating this tilt switch can be very difficult.

SUMMARY OF THE INVENTION

A need therefore exists for an improved tilt switch and cowling arrangement for an outboard motor, which arrangement will reduce the complexity and increase the convenience of accessing a manually-operated tilt switch in order to operate the tilt and trim system.

In accordance with one aspect of the present arrangement, an outboard motor for attachment to a transom of a watercraft is provided. The outboard motor comprises a power head comprising an engine substantially enclosed within a cowling, a driveshaft housing depending from the power head, and a propulsion device driven by the engine,. A tilt and trim mechanism moves the outboard motor between a raised position and a lowered position relative to the watercraft. A tilt/trim control switch controls the tilt and trim mechanism. At least two tilt/trim control switch apertures are formed through the cowling. Each of the apertures is sized and configured to receive the tilt/trim control switch. The tilt/trim control switch is positioned in one of the apertures.

In accordance with another aspect of the present arrangement, a watercraft power system is provided comprising two outboard motors adapted to be mounted side by side on a transom of a watercraft. Each of the outboard motors comprises a power head having an engine at least partially enclosed by a cowling. A driveshaft housing depends from each power head; a propulsion unit is driven by each engine; and a tilt and trim mechanism is provided for raising and lowering the associated motor relative to the transom of the watercraft. The tilt and trim mechanism comprises a manually operable control switch arranged on a side of the cowling. The switch for each motor is positioned on a side of the cowling facing away from the other motor.

These and other aspects of the present invention will become readily apparent to those skilled in the art from the following detailed description of the preferred embodiments, which refers to the attached figures. The invention is not limited, however, to the particular embodiments that are disclosed.

BRIEF DESCRIPTION OF THE DRAWINGS

These and other features, aspects and advantages of the present invention will now be described with reference to the drawings of preferred embodiments, which are intended to illustrate and not to limit the invention. The drawings comprise five figures.

DETAILED DESCRIPTION OF THE PREFERRED EMBODIMENTS

Figure 1:
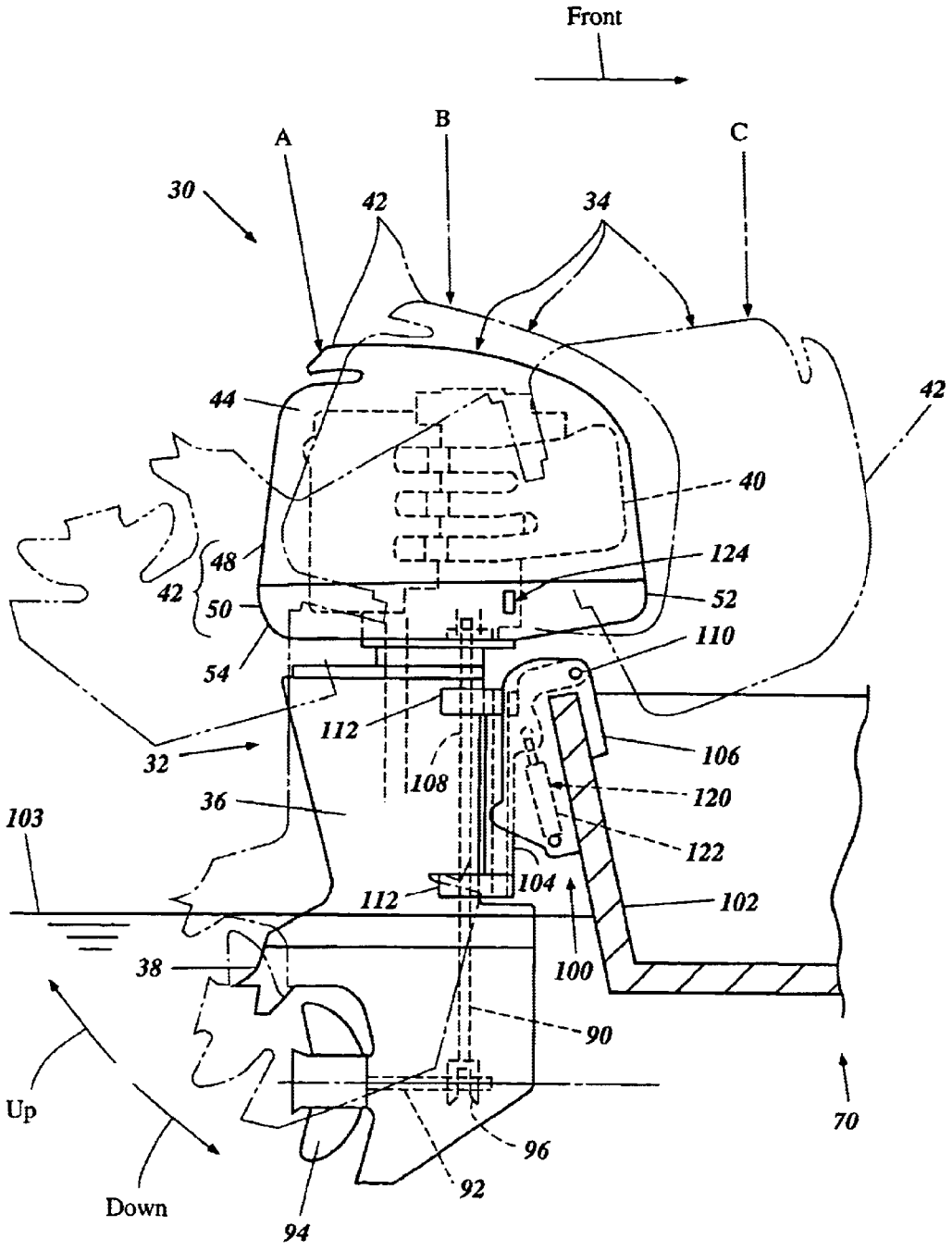
FIG. 1 is a side elevational view of an outboard motor configured in accordance with a preferred embodiment of the present tilt and trim system arrangement, and includes phantom lines showing the outboard motor in a partially raised position and a fully raised position.
Figure 2:
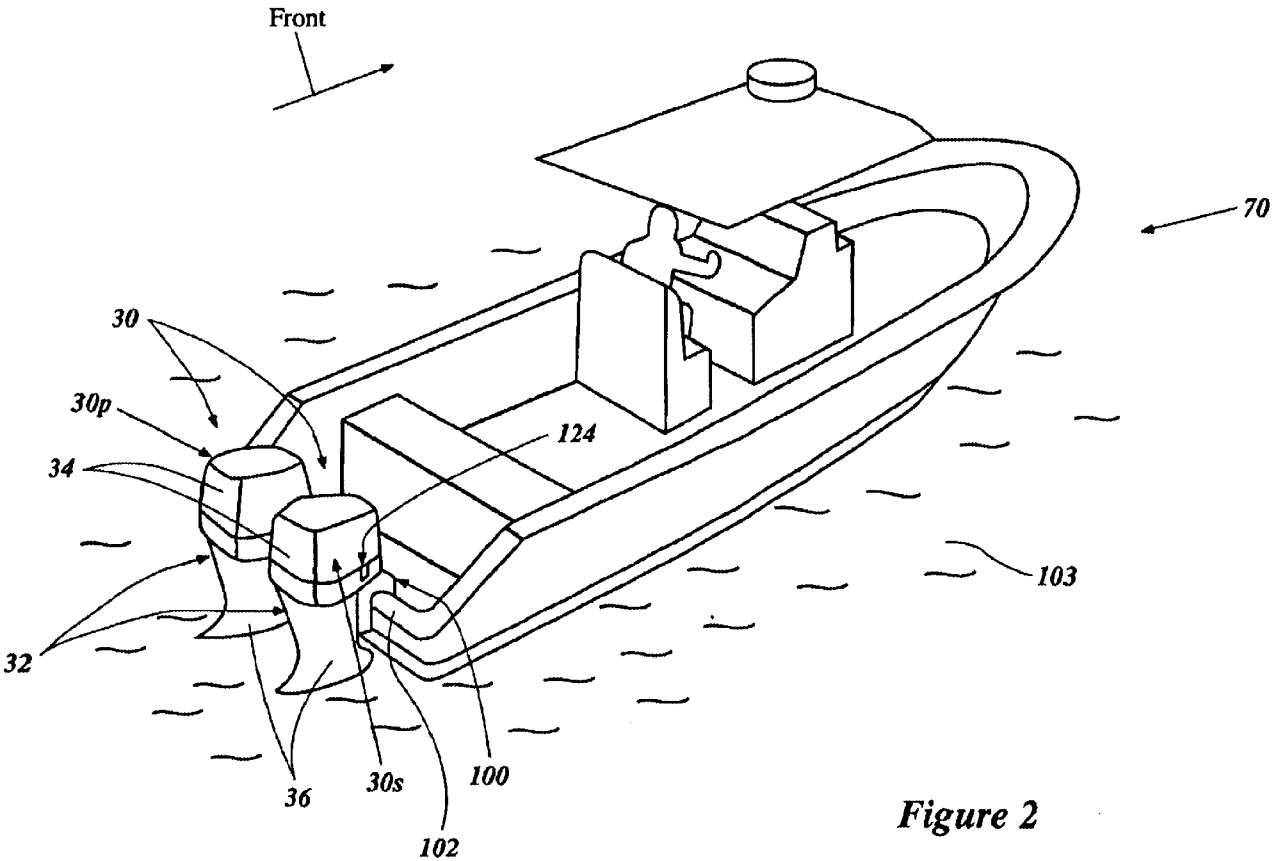
FIG. 2 is a perspective view showing a watercraft having a pair of outboard motors mounted side-by-side on a transom thereof.
Figure 3:
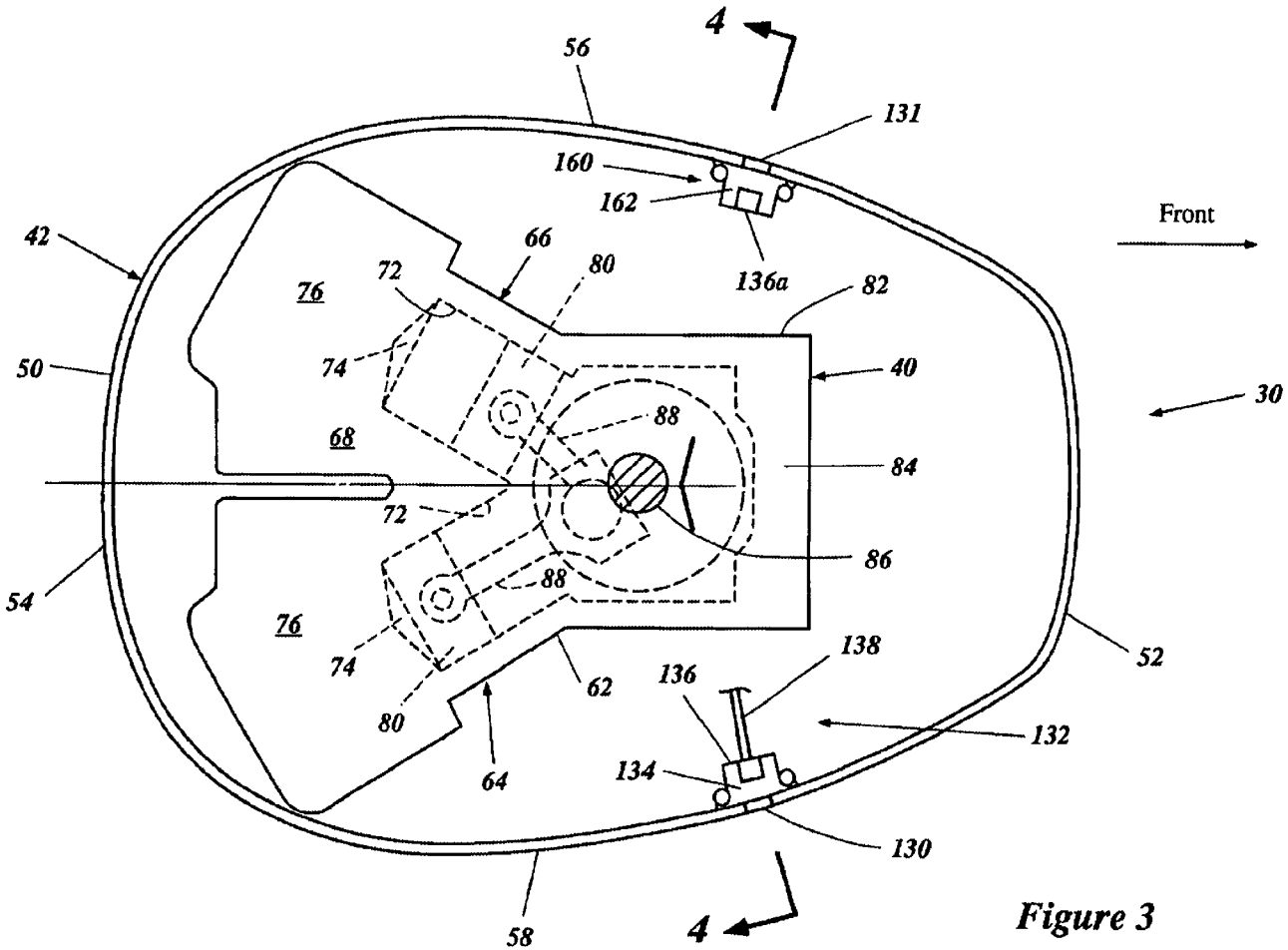
FIG. 3 is a top plan view of the power head of the outboard motor of FIG. 1 showing certain engine components in phantom.

With reference first to FIGS. 1–3, an overall construction of an outboard motor 30 that employs a tilt and trim control and cowling arrangement configured in accordance with certain features, aspects and advantages of the present invention will be described. The tilt and trim arrangement has particular utility in the context of a marine drive such as an outboard motor, and thus is described in the context of an outboard motor. The principles of the present arrangement, however, can be used with other types of marine drives.

In the illustrated arrangement, the outboard motor 30 comprises a drive unit 32 that includes a power head 34, a driveshaft housing 36 and a lower unit 38. The power head 34 is disposed atop the drive unit 32 and includes an internal combustion engine 40 that is positioned within a protective cowling 42 that preferably is made of plastic. Preferably, the protective cowling 42 defines a generally enclosed cavity 44 in which the engine 40 is disposed. The protective cowling assembly 42 preferably comprises a top cowling member 48 and a bottom cowling member 50.

The top cowling member 48 preferably is detachably affixed to the bottom cowling member 50 by a coupling mechanism so that a user, operator, mechanic or repair person can access the engine 40 for maintenance or for other purposes. The bottom cowling member 50 has front and rear walls 52, 54 and port and starboard sidewalls 56, 58 configured to correspond with the walls of the top cowling member 48. A seal member 60 (see FIG. 4) is disposed between the top and bottom cowling members 48, 50 to prevent water intrusion therebetween.

The engine 40 is placed onto a tray portion of the bottom cowling member 50. The tray portion has an opening through which burnt charges (e.g., exhaust gases) from the engine 40 are discharged. The engine in the illustrated embodiment is of the six cylinder, four-cycle variety and is arranged with its cylinders in a "V" fashion. In this arrangement, the engine 40 has a cylinder block 62 having first and second cylinder banks 64, 66.

The cylinder banks 64, 66 define a valley 68 between them. The valley 68 faces away from a watercraft 70 to which the motor 30 is attached. Each bank 64, 66 preferably defines three generally horizontally disposed cylinders 72 which are generally vertically spaced from one another. Each cylinder 72 has a combustion chamber 74 defined in the space between the cylinder 70, a corresponding cylinder head assembly 76, and a piston 80, which is moveably positioned in the cylinder 72.

As used in this description, the term "horizontally" means that the subject portions, members or components extend generally parallel to the water line 103 when the drive unit 32 is not tilted and is placed in the position marked "A" in FIG. 1. The term "vertically" means that portions, members or components extend generally normal to those that extend horizontally. The terms "forward," "forwardly" and "front" mean at or to the side where the watercraft 70 is located, and the terms "rear," "reverse," "backwardly" and "rearwardly" mean at or to the opposite side of the front side, unless indicated otherwise or otherwise readily apparent from the context use.

The illustrated engine 40 merely exemplifies one type of engine that can be used in combination with certain aspects and features of the present arrangement. Engines having other number of cylinders, having other cylinder arrangements (e.g., an in-line arrangement), and operating on other combustion principles (e.g., crankcase compression two-stroke or rotary) also can be used.

With reference to FIG. 3, a crankcase member 82 engages the cylinder banks 64, 66 to define a crankcase chamber 86 together with the cylinder banks. A crankshaft or output shaft 86 extends generally vertically through the crankcase chamber 86 and is journaled for rotation by several bearing blocks in a suitable arrangement. Connecting rods 88 couple the crankshaft 86 with the respective pistons 80 in a well-known manner. Thus, the crankshaft 86 can rotate with the reciprocal movement of the pistons 80.

In the illustrated engine 40, the pistons 80 reciprocate between top dead center and bottom dead center. When the crankshaft 86 makes two rotations, the pistons 80 generally move from top dead center to bottom dead center (the intake stroke), from bottom dead center to top dead center (the compression stroke), from top dead center to bottom dead center (the power stroke) and from bottom dead center to top dead center (the exhaust stroke).

With specific reference again to FIGS. 1 and 2, the driveshaft housing 36 depends from the power head 34 and supports a driveshaft 90 which is coupled with the crankshaft 86 and which extends generally vertically through the driveshaft housing 36. The driveshaft 90 is journaled for rotation and is driven by the crankshaft 86.

The lower unit 38 depends from the driveshaft housing 36 and supports a propulsion shaft 92 that is driven by the driveshaft 90. The propulsion shaft 92 extends generally horizontally through the lower unit 38 and is journaled for rotation. A propulsion device is attached to the propulsion shaft 92. In the illustrated arrangement, the propulsion device is a propeller 94 that is affixed to an outer end of the propulsion shaft 92. The propulsion device, however, can take the form of a dual counter-rotating system, a hydrodynamic jet, or any of a number of other suitable propulsion devices.

A transmission 96 preferably is provided between the driveshaft 90 and the propulsion shaft 92, which lie generally normal to each other (i.e., at a 90° shaft angle), to couple together the two shafts 90, 92 through bevel gears. The outboard motor 30 has a clutch mechanism that allows the transmission 96 to change the rotational direction of the propeller 94 among forward, neutral or reverse.

A bracket assembly 100 connects the drive unit 32 to a transom 102 of the associated watercraft 70 to support the outboard motor 30 thereon and to place the propulsion device in a submerged position when the watercraft 70 is resting on the surface 103 of a body of water. The bracket assembly 100 preferably comprises a swivel bracket 104, a clamping bracket 106, a steering shaft 108 and a pivot pin 110.

The steering shaft 108 typically extends through the swivel bracket 104 and is affixed to the drive unit 32 by top and bottom mount assemblies 112. The steering shaft 108 is pivotally journaled for steering movement about a generally vertically extending steering axis defined within the swivel bracket 104. The clamping bracket 106 comprises a pair of bracket arms that are spaced apart from each other and that are affixed to the watercraft transom 102.

The pivot pin 110 completes a hinge coupling between the swivel bracket 104 and the clamping bracket 106. The pivot pin 110 extends through the bracket arms so that the clamping bracket 106 supports the swivel bracket 104 for pivotal movement about a generally horizontally extending tilt axis defined by the pivot pin 110. The drive unit 32 thus can be tilted or trimmed about the pivot pin 110 through a continuous range of trim positions. For example, as shown in FIG. 1, the drive unit 32 can be tilted in an upward direction from a non-tilted position (position "A") to a partially raised position (position "B") or can be fully tilted up and out of the water (position "C") for storage or transport. Typically, the term "tilt movement", when used in a broad sense, comprises both a tilt movement and a trim adjustment movement.

A hydraulic tilt and trim adjustment system 120 preferably is provided between the swivel bracket 104 and the clamping bracket 106 for tilt movement (raising or lowering) of the swivel bracket 104 and the drive unit 32 relative to the clamping bracket 106. The hydraulic tilt and trim adjustment system 120 includes a hydraulic cylinder 122 that is driven by a hydraulic fluid motor (not shown). The hydraulic motor preferably includes a pump that pressurizes hydraulic fluid for delivery to the cylinder. A reversible electric motor drives the pump. By reversing the direction in which the pump is run, the cylinder 122 is either extended or retracted in order to raise or lower the drive unit.

It is to be understood that any of a variety of conventional hydraulic circuits or arrangements can be used for and with the tilt and trim adjustment system 120. It also is to be understood that various mechanisms other than the illustrated hydraulic tilt and trim system 120 can be appropriately used in connection with this embodiment.

A tilt and trim actuator switch 124 controls the tilt and trim adjustment system so as to effect tilt and trim movement of the outboard motor 30. Preferably, the tilt and trim switch 124 is positioned on a side of the power head 34, as shown in FIG. 2.

Figure 4:
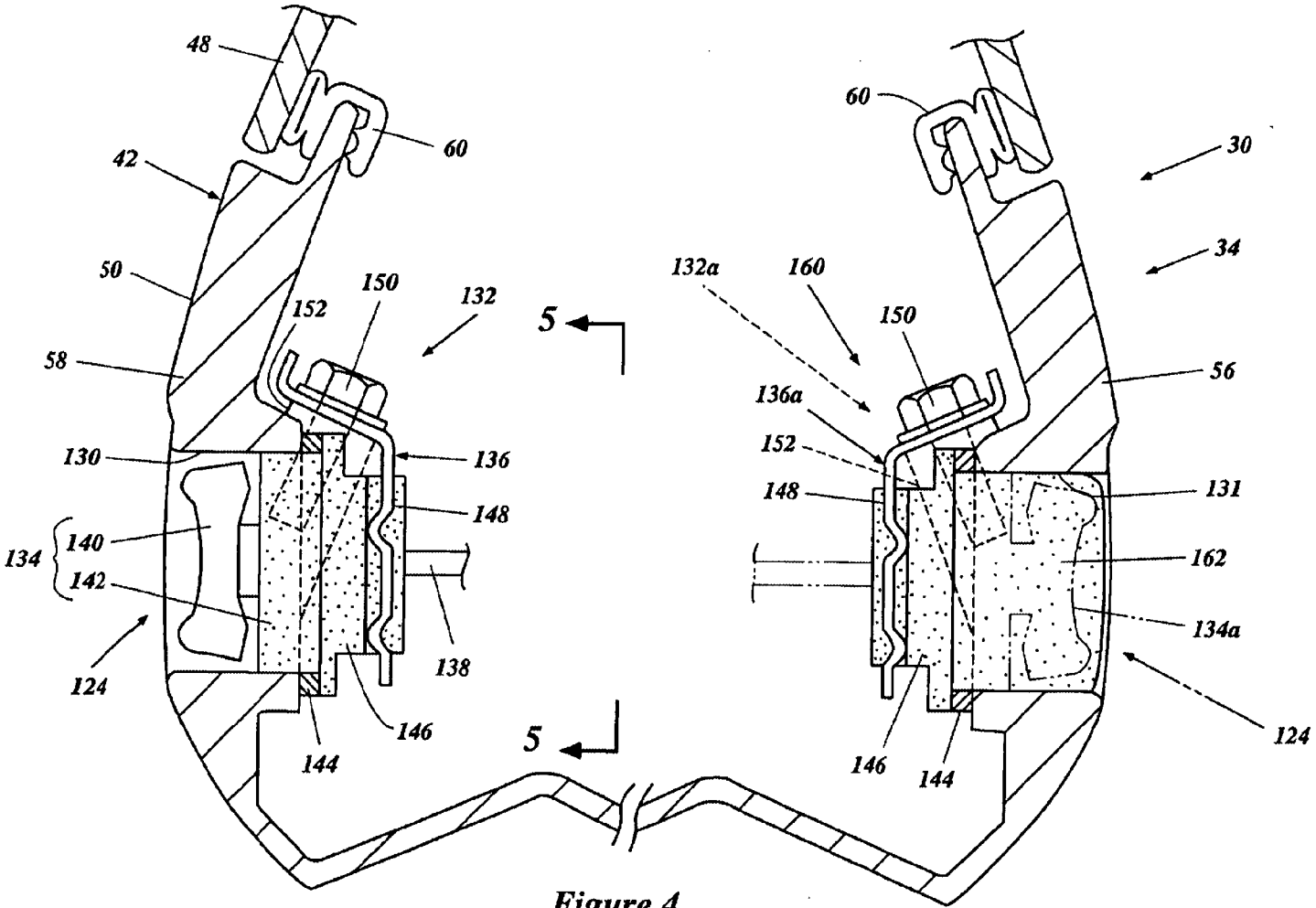
FIG. 4 is a cross-sectional partially cut-away view of the cowling of the outboard motor of FIG. 1 taken along line 4—4 of FIG. 3.

With reference to FIGS. 3 and 4, apertures 130, 131 are formed through both the port sidewall 56 and the starboard sidewall 58 of the bottom cowling portion 50 at positions preferably generally forwardly of the driveshaft 90 of the engine 40. The port and starboard apertures 131, 130 are advantageously substantially identical to each other. With specific reference to FIGS. 4 and 5, a switch unit 132 is positioned at least partially within the starboard aperture 130. The switch unit 132 comprises a tilt switch 134 and a support unit 136. An electric wire 138 is connected with the switch unit 132.

The tilt switch 134 comprises a switch body 140 and a switch base portion 142. The switch body 140 preferably comprises a three-position switch having a first, second and neutral position. Placing the switch in the first position electrically signals the electric motor to operate so that the tilt and trim system 120 raises the outboard motor 30. Conversely, placing the switch in the second position electrically signals the electric motor to operate so that the tilt and trim system 120 lowers the motor 30. The neutral position does not prompt any change in the tilt and trim position.

Of course, other types of switches and other switch control strategies can be used. For example, a control switch may have multiple settings in order to allow both fast-moving rough tilt and trim adjustment and relatively slow-moving fine trim adjustment. Also, the tilt switch can be configured for one-touch operation between various pre-set tilt and trim positions. Other types of switches that can be acceptably used include toggle switches, push-button switches, rotatable switches, etc.

Figure 5:
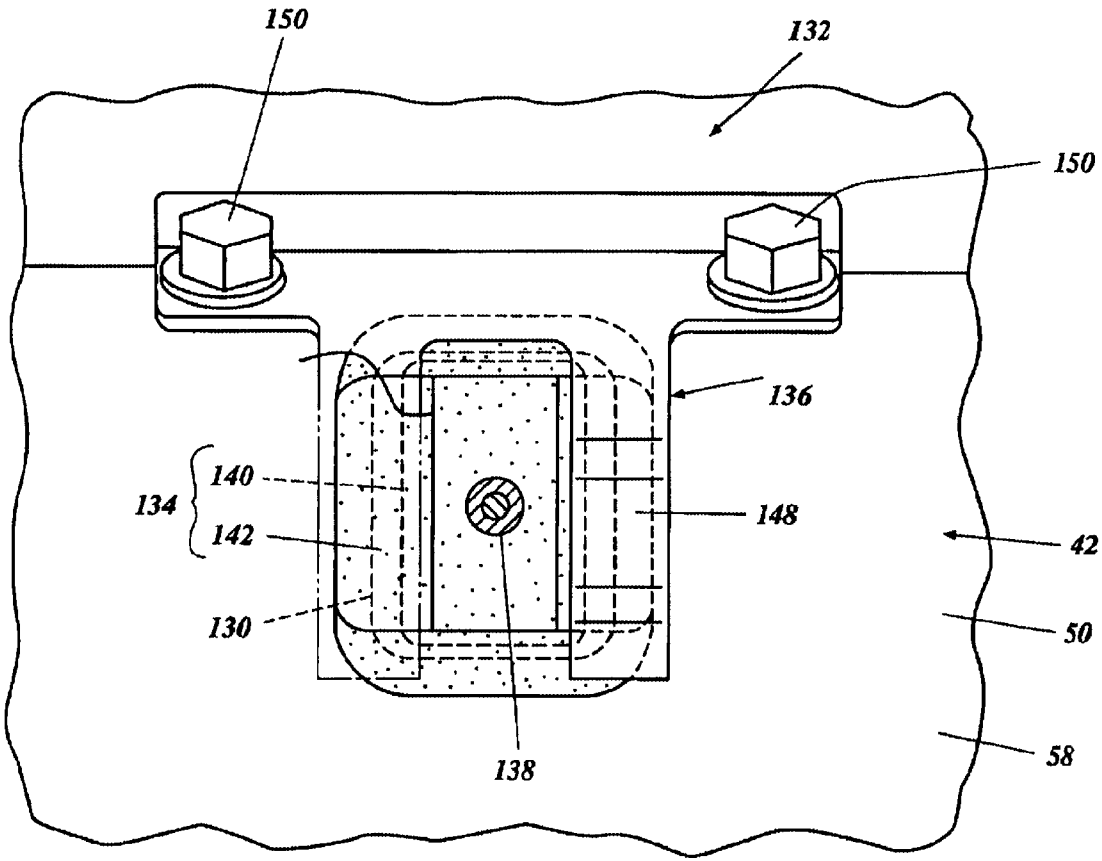
FIG. 5 is an inner side view of a switch unit taken along line 5—5 of FIG. 4 and showing some components in phantom.

With continued reference to FIGS. 4 and 5, the support unit 136 holds the tilt switch 134 securely in place within the associated aperture 130. The support unit 136 comprises a seal member 144, such as an o-ring, that surrounds at least a portion of the switch base 142 and also contacts the starboard sidewall 58. A mount back 146 contacts both the switch base 142 and the seal member 144, and is held in place by a spring plate 148. A pair of fasteners 150 engage the spring plate 148 and extend into bosses 152 formed in the sidewall 58 so as to securely hold the spring plate 148 in place. The spring plate 148 urges the mount back 146 against the switch base 142 and seal member 144 so as to hold the switch unit 132 securely in place and to establish a water seal with the cowling sidewall 58. In this manner, water that may splash against an outside surface of the cowling 42 and the switch 124 will not intrude into the cowling through the aperture 130.

In the illustrated embodiment, the switch unit 132 is installed so that the tilt switch 134 is recessed somewhat from the outer surface of the cowling 42. This configuration guards against inadvertent actuation of the switch. It is to be understood that the tilt switch 134 can be arranged with any desirable recess distance. It is also to be understood that, in some embodiments, the tilt switch can be installed so as to protrude somewhat from the aperture 130. Such installation can ease access to the switch.

As discussed above, the port sidewall aperture 131 is substantially the same size as the starboard sidewall aperture 130. In one embodiment shown in solid lines in FIG. 4, a plug unit 160 is positioned in the aperture 131 instead of a switch unit. The plug unit 160 includes a plug 162 that substantially fills the aperture 131, but does not necessarily trigger any function of the outboard motor 30. The plug unit 160 also includes a support unit **136*a* having structure similar to the starboard support unit 136. In this manner, the plug unit 162 fills and seals the port aperture 131 so that water does not intrude into the cowling through the aperture 131**.

With continued reference to FIG. 4, another embodiment is illustrated wherein a tilt switch **134*a* (shown in phantom lines) is positioned in the port aperture 131. In this embodiment, a switch unit 132*a* having substantially the same structure as the starboard switch unit 132 discussed above is placed at the port aperture 131 so that tilt switches are arranged on both sides of the motor 30. As such, the tilt and trim of the motor can be adjusted by actuating either tilt switch. Thus, operation of the tilt and trim system 120 is easier because the operator simply actuates whichever tilt switch 124** is more convenient.

It is to be understood that, in still further embodiments, a tilt switch can be arranged at one aperture, and any of various actuators and switches for other outboard motor functions can be arranged in the aperture that is not occupied by the tilt switch. For example, in one embodiment, an engine kill switch can be positioned in one aperture while a tilt switch is positioned in the other aperture.

The construction of the switch unit 132 and the plug unit 160 allows each unit to be removed from its aperture 130, 131 and installed at the opposing aperture. Thus, the present tilt switch arrangement provides increased manufacturing and customization versatility by allowing the tilt switch 124 to be movable to a side more convenient for or more desirable to a user.

Arranging the apertures through the port and starboard sidewalls 56, 58 of the bottom cowling 50 is especially advantageous because there are relatively few components in this area of the outboard motor 30. Accordingly, the same wiring harness 138 can be used even when the switch unit 132 is moved from one aperture to another aperture because interference from other engine components will not prevent repositioning and moving of the wire 138 in the area of the bottom cowling member 50 forwardly of the crankshaft 86. Further, as discussed above, the top cowling member 48 can be removed for convenient access to components enclosed therewithin. Since the switch unit 132 is mounted at the bottom cowling member 50, the associated electric wire 138 does not interfere with removal of the top cowling member 48.

As discussed above and shown in FIG. 2, it is common for a pair of outboard motors 30*p*, 30*s* to be mounted side-by-side on the transom 102 of a watercraft 70 in order to increase the power available to the watercraft. If the two outboard motors both had tilt switches arranged on the same side, such as, for example, the starboard side, the tilt switch 124 on one of the outboard motors, (i.e., the starboard motor 30*s*) would be easily accessible; however, the tilt switch 124 on the other motor (i.e. the port motor30*p*) would be positioned immediately adjacent the port side of the starboard motor 30*s*. As discussed above, there is a narrow passage between the motors 30*p*, 30*s*. Thus, it may be very difficult to access and actuate the port motor's tilt switch.

The present tilt system and cowling arrangement allows the tilt switch 124 of the port motor 30*p* to be on the port side of the motor and the tilt switch 124 of the starboard motor 30*s* to be on the starboard side of the motor. Thus, both tilt switches 124 are easily accessible.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor for attachment to a transom of a watercraft, the outboard motor including a power head comprising an engine substantially enclosed within a cowling, a driveshaft housing depending from the power head, a propulsion device driven by the engine, a tilt and trim mechanism for moving the outboard motor between a raised position and a lowered position relative to the watercraft, a tilt/trim control switch for controlling the tilt and trim mechanism, and at least two tilt/trim control switch apertures formed through opposite sides of the cowling member, each of the apertures sized and configured to receive the tilt/trim control switch, and the tilt/trim control switch being positioned in one of the apertures.

2. The outboard motor of claim 1, wherein the cowling has a top cowling member and a bottom cowling member, and wherein the apertures are formed through the bottom cowling member.

3. An outboard motor for attachment to a transom of a watercraft, the outboard motor including a power head comprising an engine substantially enclosed within a cowling, a driveshaft housing depending from the power head, a propulsion device driven by the engine, and a tilt and trim mechanism for moving the outboard motor between a raised position and a lowered position relative to the watercraft, a tilt/trim control switch for controlling the tilt and trim mechanism, at least two tilt/trim control switch apertures formed through opposite sides of the cowling member, each of the apertures being sized and configured to receive the tilt/trim control switch, the tilt/trim control switch being positioned in one of the apertures and a plug unit being positioned in the other of the apertures, wherein the plug unit substantially seals the aperture to inhibit water flow therethrough, and wherein the plug unit does not comprise an actuator or a switch.

4. The outboard motor of claim 3, wherein the engine comprises a driveshaft, and the apertures are formed in the bottom cowling member at a point forwardly of the driveshaft.

5. The outboard motor of claim 3, wherein the outboard motor has a front end, a back end, a first side wall and a second side wall, and a first one of the tilt/trim control switch apertures extends through the first side wall of the cowling and a second one of the tilt/trim control switch apertures extends through the second side wall of the cowling.

6. The outboard motor of claim 5, wherein the tilt/trim control switch is positioned in one of the first and second apertures, and the plug unit is positioned in the other of the first and second apertures.

7. The outboard motor of claim 6, wherein the control switch and the plug unit are configured so that the plug unit and control switch each can be moved between the first and second apertures.

8. The outboard motor of claim 3 additionally comprising a second tilt/trim control switch, wherein a tilt/trim control switch is positioned in both of the apertures.

9. The outboard motor of claim 8, wherein the engine comprises a V-type engine.

10. The outboard motor of claim 3, wherein the tilt/trim control switch is movable between the apertures.

11. The outboard motor of claim 3, wherein the switch is secured with a bracket disposed within the cowling.

12. The outboard motor of claim 3, wherein the cowling has a top cowling member and a bottom cowling member, and wherein the apertures are formed through the bottom cowling member.

13. A watercraft power system comprising two outboard motors adapted to be mounted side by side on a transom of a watercraft, wherein each of the outboard motors comprises a power head having an engine at least partially enclosed by a cowling, a driveshaft housing depending from the power head, a propulsion unit driven by the engine, and a tilt and trim mechanism for raising and lowering the motor relative to the transom of the watercraft, the tilt and trim mechanism comprising a manually operable control switch arranged on a side of the cowling, and the switch for each motor being positioned on a side of the cowling facing away from the other motor.

14. The system of claim 13, wherein the cowling of each engine comprises first and second receiver apertures sized and configured to accomodate the switch, the first and second receiver apertures positioned on opposing sides of the cowling, and the switch is positioned in one of the receiver apertures.

15. The system of claim 14, wherein the switch is secured with a bracket disposed within the cowling.

16. The system of claim 14, wherein a plug is positioned in the receiver aperture not occupied by the switch, and the plug does not comprise an actuator or switch.

17. The system of claim 16, wherein a waterlight seal is provided adjacent the switch and adjacent the plug so that the apertures are substantially sealed to water intrusion.

18. The system of claim 13, wherein a control switch is provided on both a starboard side and a port side of each motor cowling.

19. The system of claim 14, wherein the cowling comprises a bottom cowling member and a top cowling member, the top cowling member being removable from the bottom cowling member, and the apertures are formed through the bottom cowling member.

* * * * *

UNITED STATES PATENT AND TRADEMARK OFFICE

CERTIFICATE OF CORRECTION

PATENT NO. : 6,620,006 B2
DATED : September 16, 2003
INVENTOR(S) : Yasuo Suganuma It is certified that error appears in the above-identified patent and that said Letters Patent is hereby corrected as shown below:

Column 7,
Line 55, after "apertures" insert -- being --.

Column 8,
Line 65, delete "waterlight" and insert -- watertight --.

Signed and Sealed this

Eleventh Day of April, 2006

JON W. DUDAS
*Director of the United States Patent and Trademark Office*